US006173610B1

(12) United States Patent
Pace

(10) Patent No.: US 6,173,610 B1
(45) Date of Patent: Jan. 16, 2001

(54) SPORTS SWING IMPACT SPEED INDICATOR

(76) Inventor: Robert L. Pace, P.O. Box 557, Georgetown, FL (US) 32139

( * ) Notice: Under 35 U.S.C. 154(b), the term of this patent shall be extended for 0 days.

(21) Appl. No.: 09/221,277

(22) Filed: Dec. 23, 1998

(51) Int. Cl.[7] ..... A63B 69/00
(52) U.S. Cl. ..... 73/493; 473/233
(58) Field of Search ..... 73/491, 492, 493; 473/233, 453

(56) References Cited

U.S. PATENT DOCUMENTS

| | | | |
|---|---|---|---|
| 3,717,857 | 2/1973 | Evans | 340/177 R |
| 4,267,793 | 5/1981 | Lane et al. | 116/324 |
| 4,363,488 | 12/1982 | Maroth et al. | 273/186 A |
| 4,759,219 | 7/1988 | Cobb et al. | 73/493 |
| 4,871,168 | 10/1989 | Autorino et al. | 273/26 B |
| 4,967,596 | 11/1990 | Rilling et al. | 73/492 |
| 5,056,783 | 10/1991 | Matcovich et al. | 273/26 R |
| 5,170,664 | 12/1992 | Hirsh et al. | 73/493 |

*Primary Examiner*—John E. Chapman
(74) *Attorney, Agent, or Firm*—Edward M. Livingston, Esq.

(57) ABSTRACT

A sports swing-impact-speed indicator (1) has a solid state accelerometer (20) which measures impact speed of swing of a sports swing-impact implement during an event-time window of an event-window timer (21) following a select swing-acceleration time. The accelerometer can be a miniature solid state unit with a ratio-metric voltage signal that is directly proportional to centripetal energy imparted by travel of the implement, such as a baseball bat (2), during the event-time window. A digital readout (10) has preferably Liquid Crystal Display that can be seen in bright-light-to-dusk visibility conditions. Singular readout and selectively automated control provide simplicity of use. The unit can be attached to a desired implement such as a baseball bat with a slip-on pliable sleeve (3) or other quick-fit device. Minuteness of electronic components permits use of a small stored-energy (18) and/or solar-powered battery (19) for power.

19 Claims, 3 Drawing Sheets

SPORTS SWING IMPACT SPEED INDICATOR

BACKGROUND OF THE INVENTION

This invention relates to measurement of speed of sports swing impactors, such as ball bats traveling over home plates when being swung to hit baseballs.

The distance a baseball travels depends on two primary factors: the angle at which the ball leaves the bat and how fast the ball is hit. The speed of the ball depends on both the speed of a pitch and the speed of a bat. If the bat is standing still and the ball hits it, the ball will bounce off the bat with most, but not all, of the pitch speed. Some of the energy is wasted in the friction of deforming the ball, making a sound and so forth. If the ball is standing still and is hit by the bat, the ball is given a good portion of the bat's speed. Thus, combining the two speeds one can see that a pitched ball hitting a swinging bat gains a good portion of the sum of both the pitch speed and the bat speed. The latter of which is to be measured and improved by use of the present invention.

Measurement of speed of ball bats has been limited previously to relatively useless and misleading determination of maximum swing speed instead of effective impact speed of a bat at time of contact with a ball over a home plate. This is similar to conventional measurement of follow-through swing of a golf club for hitting a non-moving golf ball instead of hitting a baseball traveling nearly 100 miles per hour. Analysis of follow-through swing instead of impact speed of other sports swing impactors such as tennis rackets and hockey sticks, is popularized conventionally also with similarly misleading effects.

Follow-through-swing action for golfing adds grace, form and a culturally conditioned appeal to the sport. It also tends to decrease effects of individual differences resulting from different physical capabilities of players for a relatively handicapping or leveling effect in all ball-impact sports. Although inertial and vector factors are different for impact-impelling a golf ball at rest in comparison to impelling a speeding baseball, effects of impact speed of swing-impact implements are equally significant for these and for other types of sports impactors. For those who choose impact effectiveness with a differently appropriate form and grace to achieve it, this swing-speed indicator has been invented as a training instrument.

Follow-through swing analysis is misleading and partially counterproductive to achieving impact effectiveness because it obscures knowledge of speed or velocity of an impact implement during impact with an object such as a base ball, a golf ball, a tennis ball or a hockey puck. Measuring velocity of an impact implement after impact with and after generation of momentum of an impacted item is like measuring external velocity of explosive gases after a shell has left a bore. It is useless.

Like chopping with an ax or pounding with a hammer, all that counts is speed of an impact at the point of impact. An effective swing is a fast, chopping, pounding, slapping or punching impact. The more like an explosion or hammering a swing can be, the more effective it is in imparting force for acceleration of an impacted item.

Equally significant, shortness of time of travel per speed of an impactor implement that is achieved up to time of impact increases both decision-making time and impactor-manipulation time. This allows more effective control in addition to greater impact force. Consequently, it is expected that swing analysis will shift from follow-through to poundeffect analysis for those who seek effectiveness in baseball batting and other swing-impact sports.

Exemplary of a different type of sport that does use impact speed instead of follow-through speed is boxing. Known professionally, although not so well known publicly, a short, fast boxing blow with a pounding effect is far more effective than a long swing. This aspect of boxing is mentioned to demonstrate still another advantage of a short, fast swing of swinging implements. To maximize speed in short distance and also during impact of a boxing blow, body weight and strength are necessary to impel an impacting fist effectively. Speed attained per distance of impactor travel continues on through duration of physical transfer of momentum from an impactor to an impacted item as with a cannon or sledge hammer. Impact speed achieved tangentially from a swing can have the same physical impact effect as linear impact of combustion gases from explosion in a cannon or other explosive device to which impact effects are comparable for analysis. In applicably different bodily proportions for different sports, physical strength and mass of sportsmen that can be imparted to impact instruments with maximum speeds in minimum distances of travel will become increasingly significant as a result of the teachings of this invention.

Examples of different but related instruments for sports training to impact balls are described in the following patent documents. U.S. Pat. No. 5,170,664, issued to Hirsh, et al. on Dec. 15, 1992, described a relatively large, bat-mountable mechanical indicator of bat speed generally without a convenient means for indicating ball-impact speed. U.S. Pat. No. 5,056,783, issued to Matcovich, et al., on Oct. 15, 1991, described an electronic bat-insertion swing analyzer that requires alteration of a bat instead of detachable-attachment positioning on any bat and, further different, does not differentiate impact speed in a manner taught by this invention. U.S. Pat. No. 4,967,596, issued to Rilling, et al. on Nov. 6, 1990, described a tubular swing-velocity indicator that implies measurement of impact-speed travel of a physical mass but did not differentiate the impact speed from maximum velocity of swing separately and effectively. U.S. Pat. No. 4,871,168, issued to Autorino, et al. on Oct. 3, 1989, described a hollow plastic bat with an internal weighted piston for measuring maximum follow-through swing speed. U.S. Pat. No. 4,759,219, issued to Cobb, et al. on Jul. 26, 1988, described a transistor logic device inside of a baseball bat with LED readout of maximum speed achieved without relationship to impact speed. U.S. Pat. No. 4,363,488, issued to Maroth, et al. on Dec. 14, 1982, described a spring-resistance centrifugal-force analyzer for attachment to an outside of a swing-force implement to measure maximum speed attained, without differentiation from and showing of impact speed. U.S. Pat. No. 4,267,793, issued to Lane, et al. on May 19, 1981, described a spring-resistance centrifugal-force analyzer for internal positioning of a swing-force implement to measure maximum speed attained, again without differentiation from impact speed. U.S. Pat. No. 3,717,857, issued to Evans on Feb. 20, 1973, described a combination of strain gages and accelerometers for measuring flex and twist of a plate placed on an athlete's arm or inside of a bat or club to transmit gage signals as digital readout without indication of impact speed or time for achieving impact speed.

SUMMARY OF THE INVENTION

In light of need for an effective impact-speed analyzer, objects of novelty and utility taught by this invention are to provide a sports swing-impact-speed indicator which:

Analyzes and displays read out of impact speed of a sports impact instrument such as "over-the-plate" speed of a baseball bat during a ball-hitting event window that follows a select acceleration time of a swing;

Is sufficiently light and small to be carried in a user's pocket and positioned on a baseball bat or other sports impact instrument without obstructing or impeding use of the instrument for practicing;

Has attachment means for quick and easy attachment to and detachment from a standardized impact instrument for use in experiencing and exercising familiarity with targeted impact speed of the standardized impact instrument;

Has readout that is quickly and easily visible in all anticipated light conditions of use;

Facilitates familiarity with feel of impact speeds achieved in select pre-impact distances of travel of particular impact instruments that are to be used by particular athletes;

Facilitates warm-up recall of familiarity with impact speeds immediately preceding action time in a game;

Is easily and quickly activated, deactivated, set, adjusted and otherwise operated; and Is long lasting, reliable and cost efficient.

This invention accomplishes these and other objectives with a sports swing-impact-speed indicator having a solid state accelerometer which measures impact speed of swing of a sports swing-impact implement during an event-time window of an event-window timer following a select swing-acceleration time. The accelerometer can be a minute solid state unit with a ratio-metric voltage signal that is directly proportional to centripetal energy imparted by travel of the implement, such as a baseball bat, during the event-time window. Readout is preferably with Liquid Crystal Display that can be seen in bright-light-to-dusk visibility conditions. Singular readout and selectively automated control provide simplicity of use. The unit can be attached to a desired implement such as a baseball bat with a slip-on sleeve or other quick-fit device. Minuteness of electronic components permits use of a small stored-energy or solar-powered battery for power.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

Figure 1:
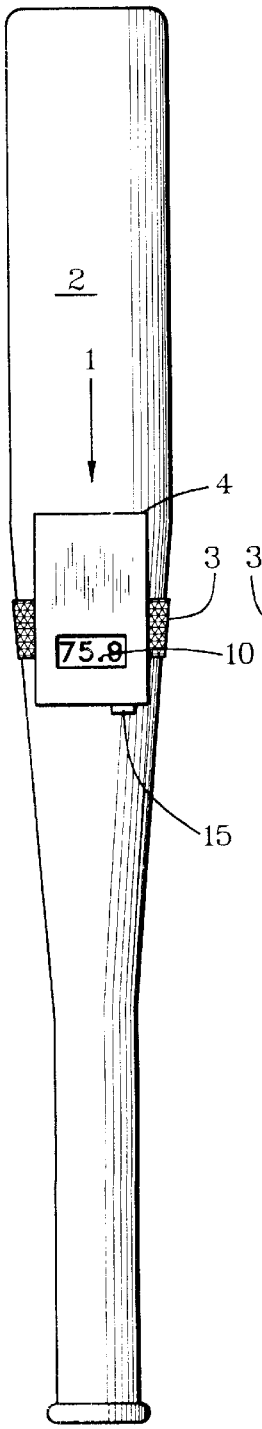
FIG. 1 is a front elevation view of a battery-powered sports swing-impact-speed indicator attached detachably to a baseball bat with a pliable sleeve.
Figure 2:
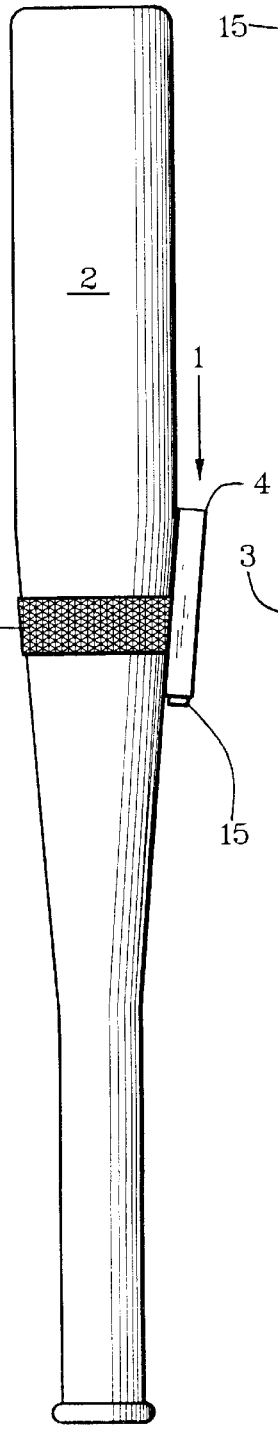
FIG. 2 is a side view of the FIG. 1 illustration.
Figure 3:
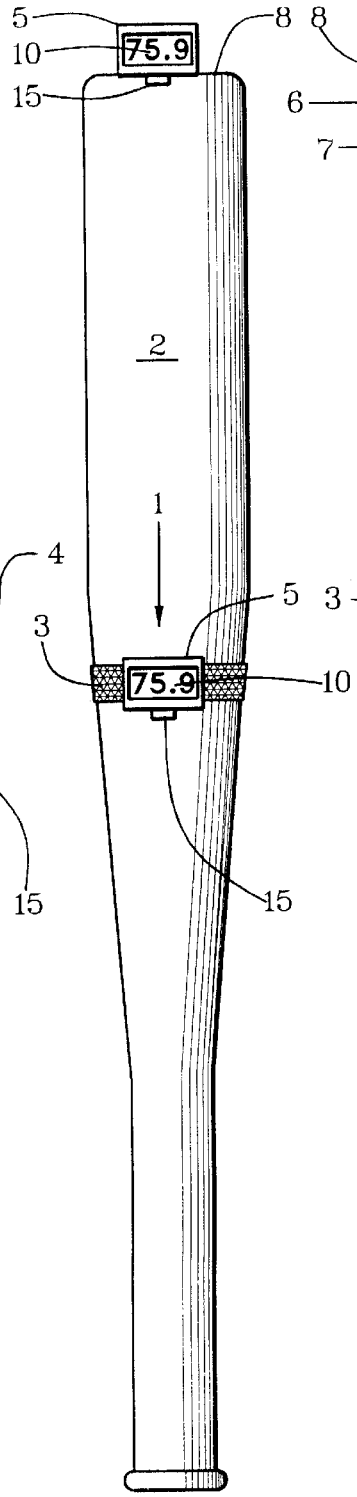
FIG. 3 is a front elevation view of a solar-powered sports swing-impact-speed indicator attached detachably to a baseball bat with a pliable sleeve or optionally with a quick-release joint.
Figure 4:
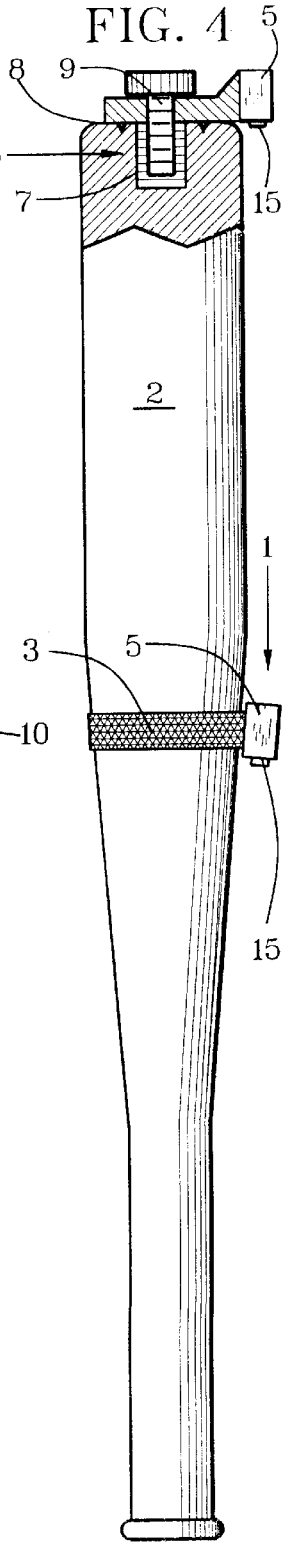
FIG. 4 is a partially cutaway side view of the FIG. 3 illustration.
Figure 5:
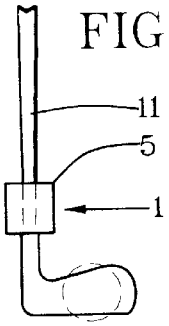
FIG. 5 is a front elevation view of a solar-powered sports swing-impact-speed indicator attached detachably to a bottom of a golf club.
Figure 6:
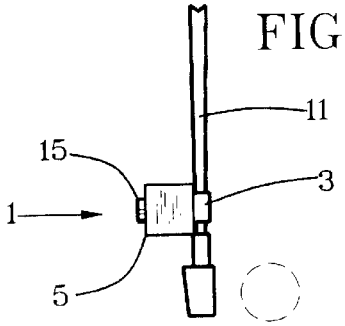
FIG. 6 is a side view of the FIG. 5 illustration.
Figure 7:
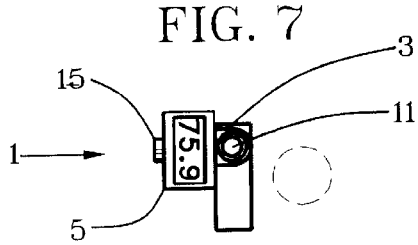
FIG. 7 is a top view of the FIG. 5 illustration.
Figure 8:
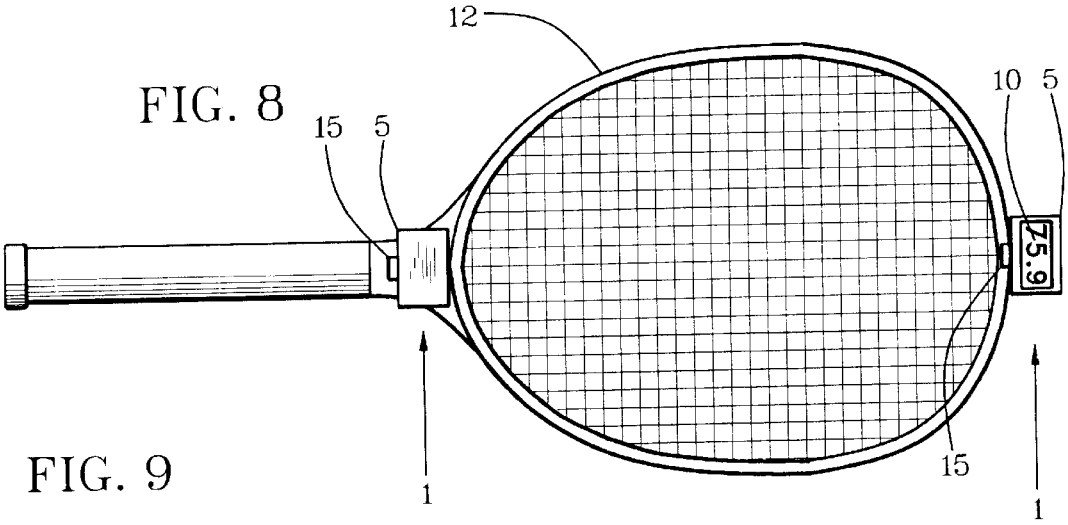
FIG. 8 is a front elevation view of solar-powered sports swing-impact-speed indicators attached detachably to a tennis racket at both ends of a strung portion of the tennis racket to illustrate optional positions for detachable attachment.
Figure 9:
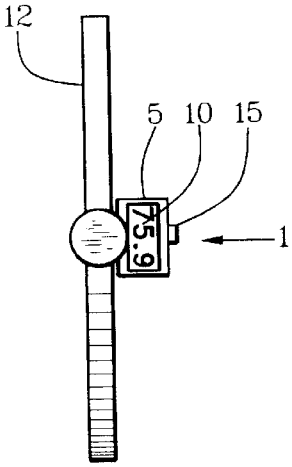
FIG. 9 is a handle-end view of the FIG. 8 illustration.
Figure 10:
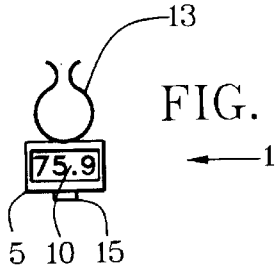
FIG. 10 is a front view of a solar-powered sports swing-impact-speed indicator having a clip for detachable attachment.
Figure 11:
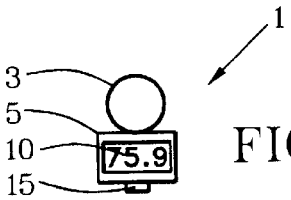
FIG. 11 is a front view of a solar-powered sports swing-impact-speed indicator having a pliable sleeve for detachable attachment.
Figure 12:
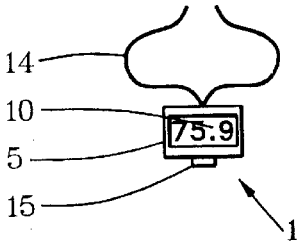
FIG. 12 is a front view of a solar-powered sports swing-impact-speed indicator having pliable line for detachable attachment.

1. Sports swing-impact-speed indicator
2. Baseball bat
3. Pliable sleeve
4. Battery unit
5. Solar-powered unit
6. Quick-release joint
7. First portion
8. End face
9. Second portion.
10. Digital readout
11. Golf club
12. Tennis racket
13. Clip
14. Pliable line
15. Control switch
16. Event-time adjuster
17. Automatization timer
18. Storage battery
19. Solar generator
20. Solid state accelerometer
21. Event-window timer
22. Data-hold timer Reference is made first to FIGS. 1–4 of the drawings. A sports swing-impact-speed indicator 1 includes an indicator housing that is sized and shaped for attachment to a sports-swing-impact implement such as a baseball bat 2 with a detachable attachment such as a pliable sleeve 3 depicted in FIGS. 1–2 for a battery unit 4. Optionally, a solar-powered unit 5 depicted in FIGS. 3–4 can be attached detachably with either the pliable sleeve 3 appropriately sized or with a quick-release joint 6 that is depicted in FIGS. 3–4. Preferably, the quick-release joint 6 has a first portion 7 such as represented by a threaded retainer in an end face 8 of the baseball bat 2 and a second portion 9 such as represented by a threaded bolt having a bolt head that retains an indicator housing of the solar-powered unit 5 as depicted in FIG. 4.

Referring to FIGS. 3–12, length and width of the solar-powered unit 5 can be nearly as small as a digital readout 10 that is preferably a liquid crystal display but optionally can be a light-emitting diode. A liquid crystal display is preferable because it is readable in brighter and in darker use conditions but can increase costs slightly.

The solar-powered unit 5 is particularly suited for detachable attachment to a golf club 11, or a tennis racket 12 with optionally the pliable sleeve 3, a clip 13 or a pliable line 14 that can be sized and shaped for either or for all of these sports wing-impact implements.

Referring to FIGS. 1–12, a preferred embodiment has a control switch 15 with push-button operation for activating the swing-impact-speed indicator 1 after a predetermined non-use time or for resetting it prior to lapse of the predetermined non-use time.

Figure 13:
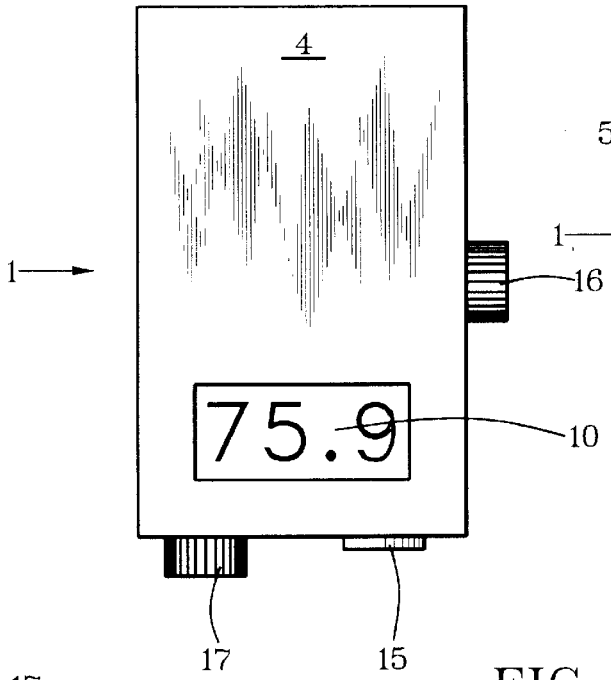
FIG. 13 is a front elevation view of a battery-powered sports swing-impact-speed indicator having an event-time adjuster and an automatization timer.
Figure 14:
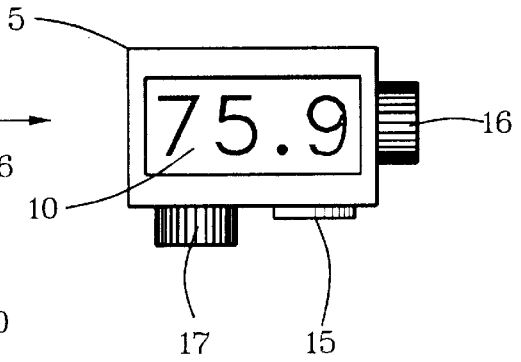
FIG. 14 is a front elevation view of a solar-powered sports swing-impact-speed indicator having an event-time adjuster and an automatization timer.

Referring to FIGS. 13–14, an event-time adjuster 16 for pre-impact time-lapse adjustment and an automatization timer 17 to automate resetting for convenient exercising use repeatedly are separate options.

Figure 15:
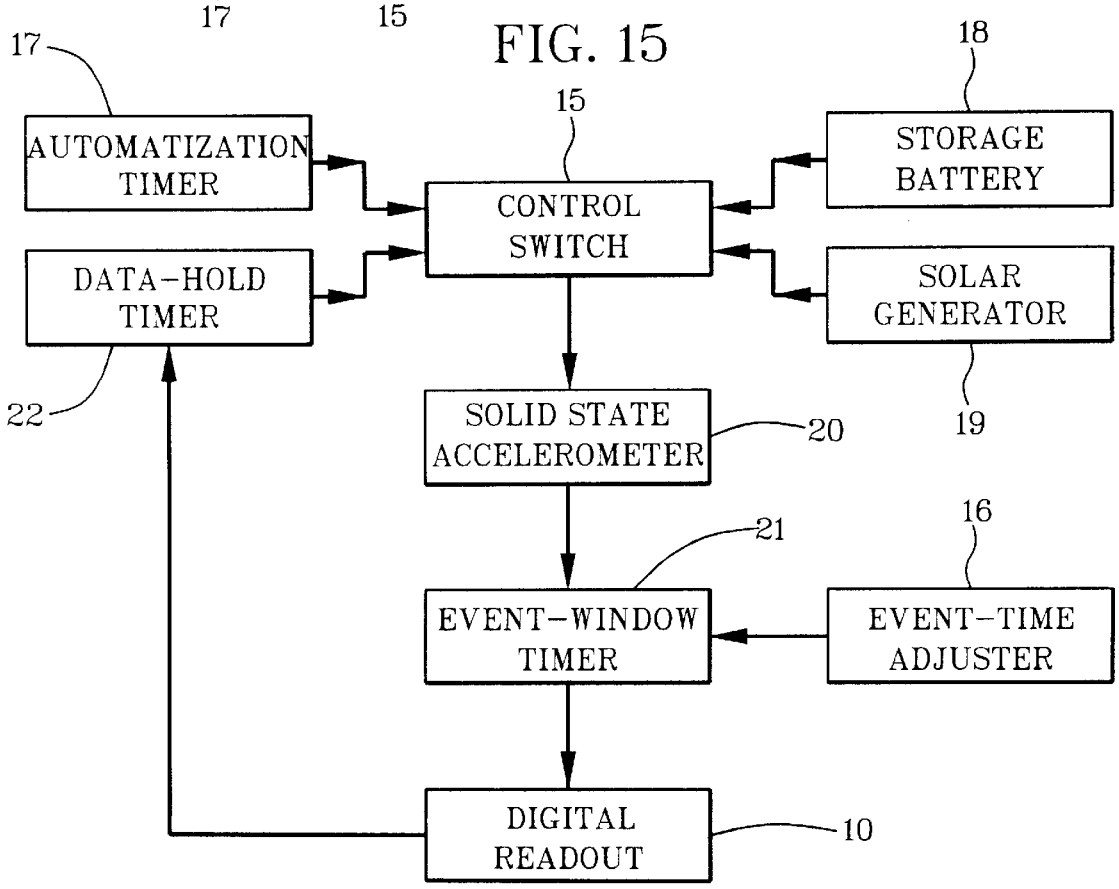
FIG. 15 is a block diagram of a sports swing-impact-speed indicator having optionally solar power and/or battery power, an optional automatization timer, and an optional event-time adjuster.

As shown in the block diagram of FIG. 15, the sports swing-impact-speed indicator 1 has a storage battery 18 and/or a solar generator 19 as a source of electrical current having controllable communication from the source of electrical current to a solid-state accelerometer 20, to an event-window timer 21 and to the digital readout 10. For an embodiment with only a push-button control switch 15, the solid-state accelerometer 20 detects swing speed of swing of the sports swing-impact implement, such as a baseball bat 2, a golf club 11 or a tennis racket 12, with centripetal force at an event time such as ball-impact time after a predetermined period of time set by the event-window timer 21 for the swing-impact implement to achieve the swing speed. The digital readout 10 displays and holds the swing speed for a time period determined by a data-hold timer 22 before shutting off the electrical current and thereby also terminating the display by the digital readout 10.

The automatization timer 17 is configured and positioned in communication with the control switch 15 to switch the control switch 15 on for activation and off for deactivation of the solid state accelerometer 20 in accordance with the event-window timer 21 for display by the digital readout 10 repeatedly for a select continuance of usage for exercising achievement of targeted swing speeds. In addition, the automatization timer 17 can be configured and positioned in communication with the control switch 15 to switch the control switch 15 off for deactivation of the solid state accelerometer 20, the event-window timer 21 and the digital readout 10 following a predetermined period of time after non-use.

The components represented in the block diagram of FIG. 15 can be structured with a selection of analog and digital solid state and electrical components and their arrangements. The solid state accelerometer 20 is analog and the digital readout 10, for instance, is digital. Between them are optional arrangements of amplifiers and timers, capacitors, lines and connections to accomplish functions indicated for the designated components.

To use the preferred push-button embodiment of this invention, an athlete first attaches it detachably to a standard or regulation impact implement such as a baseball bat 2, a golf club 11 or a tennis racket 12. Then when the athlete is about ready to practice swinging, the push-button control switch 15 is pushed to activate it for indicating swing speed at impact time. After each practice swing, the athlete reads the swing speed on the digital readout 10 for comparing actual with targeted swing speeds in order to determine possible speed or swing adjustments. Then the push-button switch 15 is pushed again repeatedly as desired for additional practice swings.

A fundamental object is to gain familiarity with feel of targeted swing speed within a desired time of swinging before impact. A second object is to practice swing control in order to hit a ball exactly as desired. The invention shuts itself off after non-use for a predetermined period of time.

To use an embodiment of the invention having an automatization timer 17, the athlete turns on the automatization timer 17 and practices repeatedly without having to reset or to push the control switch 15 again, provided there is insufficient delay time between swings for the invention to shut itself off.

To use an embodiment of the invention with an event-time adjuster 16, desired swing time before an event window to occur after initiation of a swing is determined and entered into the event-window timer 21 with the event-time adjuster 16. Achieving a desired swing speed within a desired swing time is then practiced with applicable swing techniques for different swing-impact sports. A baseball player would swing in desired degrees of horizontality with both hands grasping a baseball bat 2. A golfer would swing in desired degrees of verticality with both hands grasping a golf club 11. A tennis player would swing in desired degrees of horizontality or verticality with either two hands or one hand grasping a tennis racket 12.

Swing speeds will differ in proportion to length of baseball bats, tennis rackets and golf clubs. This difference can either be factored out or retained. Swing speeds will differ in proportion to how near an impact end the invention is positioned from a handle of an impact implement. This difference likewise can be either factored out or retained and accounted for as desired.

Different from all other swing-analysis devices for practicing swing impact with swing-impact implements, this sports swing-impact-speed indicator 1 measures impact speed precisely without inexact and generally misleading interpolation from measurement of maximum speed of a follow-through swing. It affects the nature of all swing-impact sports. All players will be making shorter, faster and better-controlled pounding and chopping swings with minimal follow-through swinging. Achievement of hits and home runs will increase in base ball. Golf and tennis scores will improve. Professional accomplishment will be greater for all.

A new and useful sports swing-impact-speed indicator having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A sports swing-impact-speed indicator comprising:

a solid state accelerometer positioned in an indicator housing that is sized and shaped for attachment to a predetermined sports swing-impact implement with a detachable attachment;

a digital readout positioned on the indicator housing and having swing-speed-data communication from the solid state accelerometer;

an event-window timer with timed metering of swing speed of the sports swing-impact implement by the solid state accelerometer for communication of the swing-speed data from the solid state accelerometer to the digital readout;

the event-window timer being timed for the solid state accelerometer to meter the swing speed of the sports swing-impact implement at an event-window time for contact of the sports swing-impact implement with an item targeted for impact by the sports swing-impact implement after initiation of swinging of the sports swing-impact implement;

a source of electrical current attached to the indicator housing;

at least one control switch on the indicator housing in controllable communication of electrical current from the source of electrical current to the solid state accelerometer, to the event-window timer and to the digital readout; and a data-hold timer in electrical communication with the digital readout for the digital readout to hold the swing-speed data a predetermined period of time before the control switch is switched off.

2. A sports swing-impact-speed indicator as described in claim 1 wherein:

the source of electrical current is a storage battery.

3. A sports swing-impact-speed indicator as described in claim 1 wherein:

the source of electricity is a solar generator.

4. A sports swing-impact-speed indicator as described in claim 1 wherein:

the digital readout is a liquid crystal display.

5. A sports swing-impact-speed indicator as described in claim 1 wherein:

the digital readout is a light-emitting diode.

6. A sports swing-impact-speed indicator as described in claim 1 wherein:

the predetermined sports swing-impact implement is a baseball bat.

7. A sports swing-impact-speed indicator as described in claim 6 wherein:

the detachable attachment is a pliable sleeve affixed to the indicator housing and having an inside periphery that is sized to fit onto an outside periphery of the baseball bat proximate a confluence of a handle and a major diameter of the baseball bat.

8. A sports swing-impact-speed indicator as described in claim 6 wherein:

the detachable attachment is a quick-release joint having a first portion of the quick-release joint on an end face of the baseball bat and a second portion of the quick-release joint on the indicator housing.

9. A sports swing-impact-speed indicator as described in claim 1 wherein:

the predetermined sports swing-impact implement is a golf club.

10. A sports swing-impact-speed indicator as described in claim 9 wherein:

the detachable attachment is a flexible sleeve affixed to the indicator housing and having an inside periphery that is sized to fit onto an outside periphery of the golf club proximate a confluence of a handle and a head of the golf club.

11. A sports swing-impact-speed indicator as described in claim 9 wherein:

the detachable attachment is a clip having an inside periphery that is sized to fit onto an outside periphery of the golf club proximate a confluence of a handle and a head of the golf club.

12. A sports swing-impact-speed indicator as described in claim 1 wherein:

the predetermined sports swing-impact implement is a tennis racket.

13. A sports swing-impact-speed indicator as described in claim 12 wherein:

the detachable attachment is a pliable line having a length that is sized to fit onto and to be fastened onto a desired portion of an outside periphery of the tennis racket.

14. A sports swing-impact-speed indicator as described in claim 12 wherein:

the detachable attachment is a clip having an inside periphery that is sizable to fit onto a desired portion of an outside periphery of the tennis racket.

15. A sports swing-impact-speed indicator as described in claim 1 wherein:

the digital readout has a data-hold timer;

the data-hold timer is configured and positioned in communication with the control switch to switch the control switch off for deactivation of the solid state accelerometer, the event-window timer and the digital readout following a predetermined period of time after non-use of the sports swing-impact-speed indicator for metering impact speed of the sports swing-impact implement.

16. A sports swing-impact-speed indicator as described in claim 1 wherein:

the control switch is a push-button switch.

17. A sports swing-impact-speed indicator as described in claim 1 wherein:

the event-window timer has an event-time adjuster with which the event-window time for contact of the sports swing-impact implement with the item targeted for impact after the initiation of swinging is adjustable.

18. A sports swing-impact-speed indicator as described in claim 1 wherein:

the control switch has an automatization timer; and the automatization timer is configured and positioned in communication with the control switch to switch the control switch on for activation and off for s deactivation of the solid state accelerometer, the event-window timer and the digital readout repeatedly for a select continuance of usage of the sports swing-impact-speed indicator for metering impact speed of the sports swing-impact implement.

19. A sports swing-impact-speed indicator as described in claim 16 wherein:

the event-window timer has an event-time adjuster with which the event-window time for contact of the sports swing-impact implement with the item targeted for impact after the initiation of swinging is adjustable;

the control switch has an automatization timer;

the automatization timer is configured and positioned in communication with the control switch to switch the control switch on for activation and off for deactivation of the solid state accelerometer, the event-window timer and the digital readout repeatedly for a select continuance of use of the sports swing-impact-speed indicator for metering impact speed of the sports swing-impact implement; and the automatization timer is configured and positioned in communication with the control switch to switch the control switch off for deactivation of the solid state accelerometer, the event-window timer and the digital readout following a predetermined period of time after non-use of the sports swing-impact-speed indicator for metering impact speed of the sports swing-impact implement.

* * * * *